US010679580B2

(12) United States Patent
Wang et al.

(10) Patent No.: US 10,679,580 B2
(45) Date of Patent: Jun. 9, 2020

(54) PIXEL CIRCUIT, DRIVING METHOD THEREOF AND DISPLAY PANEL

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Xiujuan Wang, Beijing (CN); Xianjie Shao, Beijing (CN)

(73) Assignees: BOE TECHNOLOGY GROUP CO., LTD., Beijing (CN); HEFEI BOE OPTOELECTRONICS TECHNOLOGY CO., LTD., Hefei (CN)

( * ) Notice: Subject to any disclaimer, the term of this patent is extended or adjusted under 35 U.S.C. 154(b) by 136 days.

(21) Appl. No.: 15/928,021

(22) Filed: Mar. 21, 2018

(65) Prior Publication Data

US 2019/0147826 A1 May 16, 2019

(30) Foreign Application Priority Data

Nov. 13, 2017 (CN) ..... 2017 1 1112525

(51) Int. Cl.
*G09G 3/36* (2006.01)
*G09G 3/20* (2006.01)

(52) U.S. Cl.
CPC ..... *G09G 3/3696* (2013.01); *G09G 3/20* (2013.01); *G09G 2300/0857* (2013.01)

(58) Field of Classification Search
CPC ..... G09G 3/3648; G09G 2300/0857; G09G 2330/021; G09G 3/3614; G09G 3/3696
USPC ..... 345/212, 690
See application file for complete search history.

(56) References Cited

U.S. PATENT DOCUMENTS

| | | | | |
|---|---|---|---|---|
| 6,765,549 | B1 * | 7/2004 | Yamazaki | G09G 3/3266 345/80 |
| 8,878,881 | B2 * | 11/2014 | Li | G09G 3/3607 345/211 |
| 2016/0321990 | A1 * | 11/2016 | Kim | G09G 3/3233 |
| 2018/0114497 | A1 * | 4/2018 | Tan | G09G 3/3648 |

* cited by examiner

*Primary Examiner* — Calvin C Ma
(74) *Attorney, Agent, or Firm* — Kinney & Lange, P.A.

(57) ABSTRACT

The present disclosure provides a pixel circuit, a driving method thereof and a display panel. In the pixel circuit, the storage module stores a written data signal at a first node, and then the potential of the second node is controlled according to the stored data signal, so that the pixel circuit outputs a driving signal for driving a pixel unit to emit light under the control of key nodes (i.e. the first node and a second node) to achieve normal light emission of the pixel. When the pixel circuit is applied in a display device, the data signal stored by the storage module may replace a data signal input from a data line when a still picture is displayed.

16 Claims, 6 Drawing Sheets

PIXEL CIRCUIT, DRIVING METHOD THEREOF AND DISPLAY PANEL

CROSS REFERENCE TO RELATED APPLICATION

This application claims the benefit of the Chinese patent application 201711112525.4, entitled "Pixel Circuit, Driving Method thereof and Display Panel," filed on Nov. 13, 2017, which is incorporated herein by reference.

TECHNICAL FIELD

The disclosure relates to relates to the field of display technology, and particularly to a pixel circuit, a driving method thereof and a display panel.

BACKGROUND

Currently, display technology is widely used in the display of televisions, mobile phones, and public information. Flat panel displays used for displaying pictures have been greatly popularized due to their advantages of ultra-thinness and power-saving. With the advancement of technology and the development of productivity, the use of wearable display devices has become more and more widespread. It has become imperative to reduce the power consumption of wearable display devices and increase their lifetime.

Therefore, how to reduce the power consumption of the display device is a technical problem to be solved by those skilled in the art.

SUMMARY

Embodiments of the present disclosure provide a pixel circuit, a driving method thereof and a display panel, which can reduce the power consumption of the display device to some extent.

An embodiment of the present disclosure provides a pixel circuit, including: a writing module, a driving module, and a storage module; wherein an output terminal of the writing module is connected to the storage module via a first node; and the writing module is configured to output a data signal at the first node under the control of a scan signal; the storage module is connected between the first node and a second node; the storage module is configured to control the potential of the second node under the control of a first power signal and a second power signal, together with the data signal outputted by the writing module which has been received and stored in the storage module; the driving module connects to the first node and to the second node; the driving module is configured to generate, at a third node, a drive signal for driving a pixel unit to emit light under the control of a common voltage signal, a first display signal, a second display signal, and the potentials of the first node and the second node.

In a possible implementation, in the foregoing pixel circuit according to the embodiment of the present disclosure, the storage module includes: a first switch transistor, a second switch transistor, and a third switch transistor; wherein a gate and a first electrode of the first switch transistor are connected to receive the first power supply signal, and a second electrode of the first switch transistor is connected to the second node; a gate of the second switch transistor is connected to the second node, a first electrode of the second switch transistor is connected to receive the second power signal, and a second electrode of the second switch transistor is connected to the first node; a gate of the third switch transistor is connected to the first node, a first electrode of the third switch transistor is connected to receive the second power signal, and a second electrode of the third switch transistor is connected to the second node. The first electrode of one of the first, second and third switch transistors is one of a source and a drain, and the second electrode is the other one of the source and the drain.

In a possible implementation, in the foregoing pixel circuit according to the embodiment of the present disclosure, the first switch transistor, the second switch transistor and the third switch transistor are N-type transistors.

In a possible implementation, in the foregoing pixel circuit according to the embodiment of the present disclosure, the first power signal is a high-level signal, and the second power signal is a low-level signal.

In a possible implementation, in the foregoing pixel circuit according to the embodiment of the present disclosure, a first control terminal of the driving module is connected to the first node, a second control terminal of the driving module is connected to the second node, a first input terminal of the driving module is connected to receive the first display signal, a second input terminal of the driving module is connected to receive the second display signal, a third input terminal of the driving module is connected to receive the common voltage signal, and the driving module is configured to generate, at the third node, a drive signal for driving a pixel unit to emit light, under the control of the first node and the second node, according to the first display signal, the second display signal, and the common voltage signal.

In a possible implementation, in the foregoing pixel circuit according to the embodiment of the present disclosure, the driving module includes: a fourth switch transistor, a fifth switch transistor, and a capacitor; wherein a gate of the fourth switch transistor is connected to the first node, a first electrode of the fourth switch transistor is connected to receive the first display signal, and a second electrode of the fourth switch transistor is connected to the third node; a gate of the fifth switch transistor is connected to the second node, a first electrode of the fifth switch transistor is connected to receive the second display signal, and a second electrode of the fifth switch transistor is connected to the third node; one terminal of the capacitor is connected to receive the common voltage signal, and the other terminal is connected to the third node; wherein, the first electrode of one of the fourth and fifth switch transistors is one of a source and a drain, and the second electrode is the other one of the source and the drain.

In a possible implementation, in the foregoing pixel circuit according to the embodiment of the present disclosure, the common voltage signal is in phase with the first display signal, and out of phase with the second display signal.

In a possible implementation, in the foregoing pixel circuit according to the embodiment of the present disclosure, a first control terminal of the driving module is connected to receive the first display signal, a second control terminal of the driving module is connected to receive the second display signal, a first input terminal of the driving module is connected to the first node, a second input terminal of the driving module is connected to the second node, a third input terminal of the driving module is connected to receive the common voltage signal, and the driving module is configured to generate, at the third node, a drive signal for driving a pixel unit to emit light, under the control of the first display signal and the second display signal, according to the potentials of the first node and the second node, and the common voltage signal.

In a possible implementation, in the foregoing pixel circuit according to the embodiment of the present disclosure, the driving module includes: a fourth switch transistor, a fifth switch transistor, and a capacitor; wherein a gate of the fourth switch transistor is connected to receive the first display signal, a first electrode of the fourth switch transistor is connected to the first node, and a second electrode of the fourth switch transistor is connected to the third node; a gate of the fifth switch transistor is connected to receive the second display signal, a first electrode of the fourth switch transistor is connected to the second node, and a second electrode of the fourth switch transistor is connected to the third node; one terminal of the capacitor is connected to receive the common voltage signal, and the other terminal is connected to the third node, wherein, the first electrode of one of the fourth and fifth switch transistors is one of a source and a drain, and the second electrode is the other one of the source and the drain.

In a possible implementation, in the foregoing pixel circuit according to the embodiment of the present disclosure, the common voltage signal is in phase with the first display signal, and out of phase with the second display signal.

In a possible implementation, in the foregoing pixel circuit according to the embodiment of the present disclosure, a control terminal of the writing module is connected to receive the scan signal, an input terminal of the writing module is connected to receive the data signal, and an output terminal of the writing module is connected to the first node; the write module is configured to output the data signal at the first node under the control of the scan signal.

In a possible implementation, in the foregoing pixel circuit according to the embodiment of the present disclosure, the writing module includes: a sixth switch transistor; a gate of the sixth switch transistor is connected to receive the scan signal, a first electrode of the sixth switch transistor is connected to receive the data signal, and a second electrode of the sixth switch transistor is connected to the first node; wherein, the first electrode of the sixth switch transistors is one of a source and a drain, and the second electrode is the other one of the source and the drain.

An embodiment of the present disclosure provides a display panel including the above pixel circuit according to the embodiment of the present disclosure.

An embodiment of the present disclosure provides a method for driving the foregoing pixel circuit according to the embodiment of the present disclosure, including: applying a common voltage signal, a first display signal and a second display signal; inputting a valid scan signal, wherein the writing module outputs a data signal to the storage module under the control of the scan signal; and inputting an invalid scan signal after one scan period.

DETAILED DESCRIPTION

Specific implementations of a pixel circuit, a driving method thereof and a display panel according to the embodiments of the present disclosure will be described in detail below with reference to the accompanying drawings.

Figure 1:
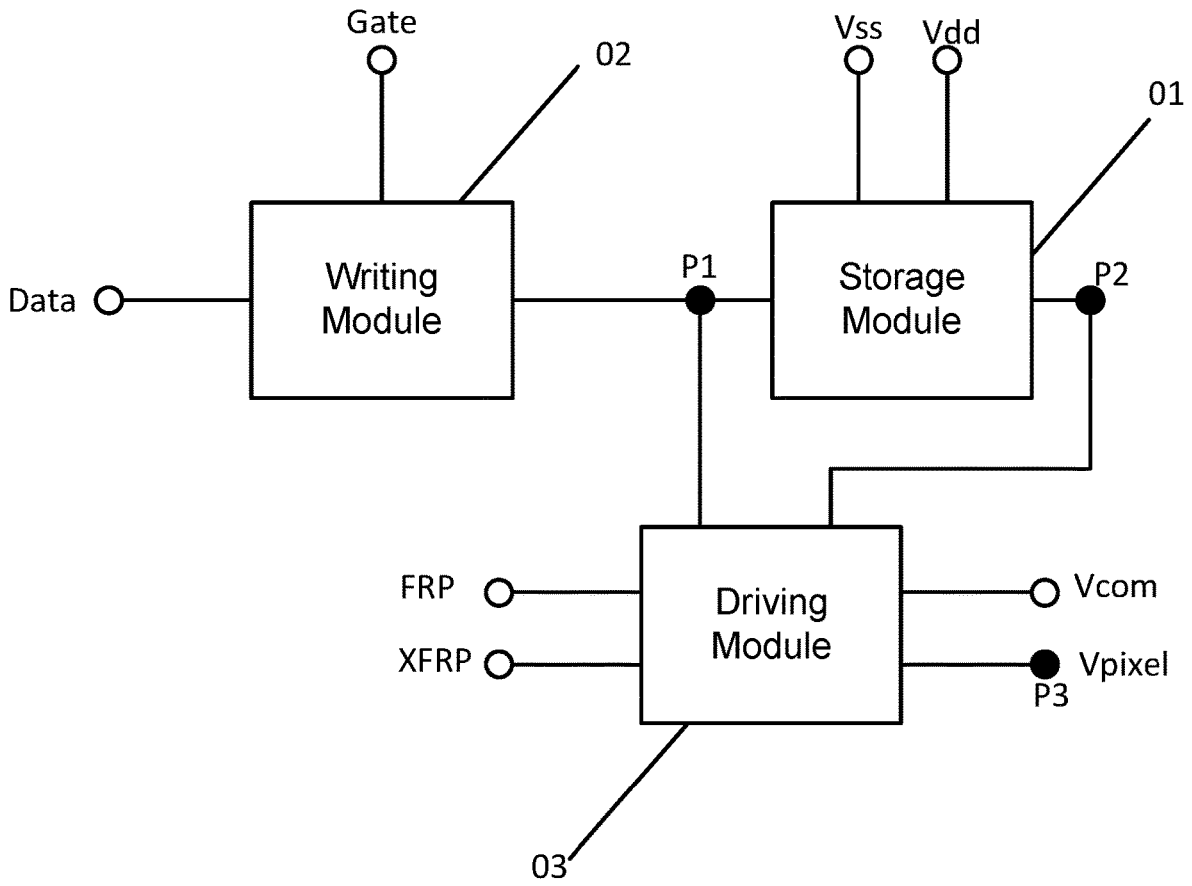
FIG. 1 to FIG. 3 are schematic structural diagrams of pixel circuits according to embodiments of the present disclosure.

An embodiment of the present disclosure provides a pixel circuit. As shown in FIG. 1, the pixel circuit may include: a writing module 02, a driving module 03, and a storage module 01. An output terminal of the writing module 02 is connected to the storage module 01 via a first node P1. The writing module 02 is configured to output a data signal Data at the first node P1 under the control of a scan signal Gate. The storage module 01 is connected between the first node P1 and a second node P2. The storage module 01 is configured to control the potential of the second node P2 under the control of a first power signal Vdd and a second power signal Vss, together with the data signal Data outputted by the writing module 02 which has been received and stored in the storage module. The driving module 03 connects to the first node P1 and to the second node P2. The driving module 03 is configured to output at a third node P3 a drive signal for driving a pixel unit to emit light under the control of a common voltage signal Vcom, a first display signal FRP, a second display signal XFRP, and the potentials of the first node P1 and the second node P2. That is, the voltage signal Vpixel of the third node P3 is used to drive the pixel unit to emit light.

In the pixel circuit according to the embodiment of the present disclosure, the data signal is stored in the first node by the storage module, and then the potential of the second node is controlled according to the stored data signal, so that the pixel circuit outputs a driving signal for driving the pixel unit to emit light under the control of key nodes (i.e., the first node and the second node) to achieve normal light emission of the pixel. When the pixel circuit is applied in a display device, the data signal stored by the memory module may replace a data signal input by a data line when a still picture is displayed, which can reduce the power consumption of the display device. Meanwhile, the pixel circuit of the present disclosure has a simple structure and facilitates the reduction of the area occupied by the pixel circuit.

Figure 2:
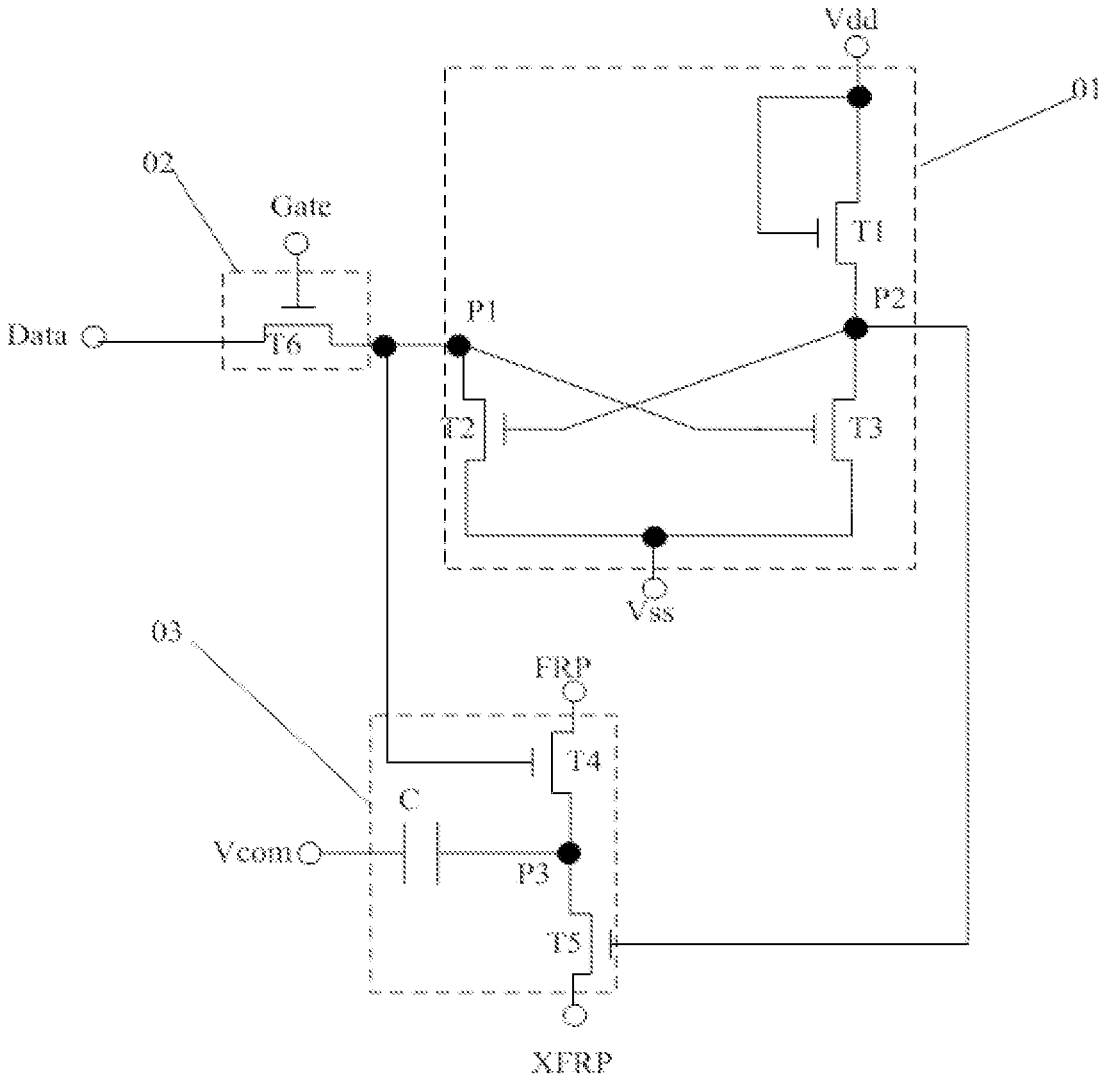
Figure 3:
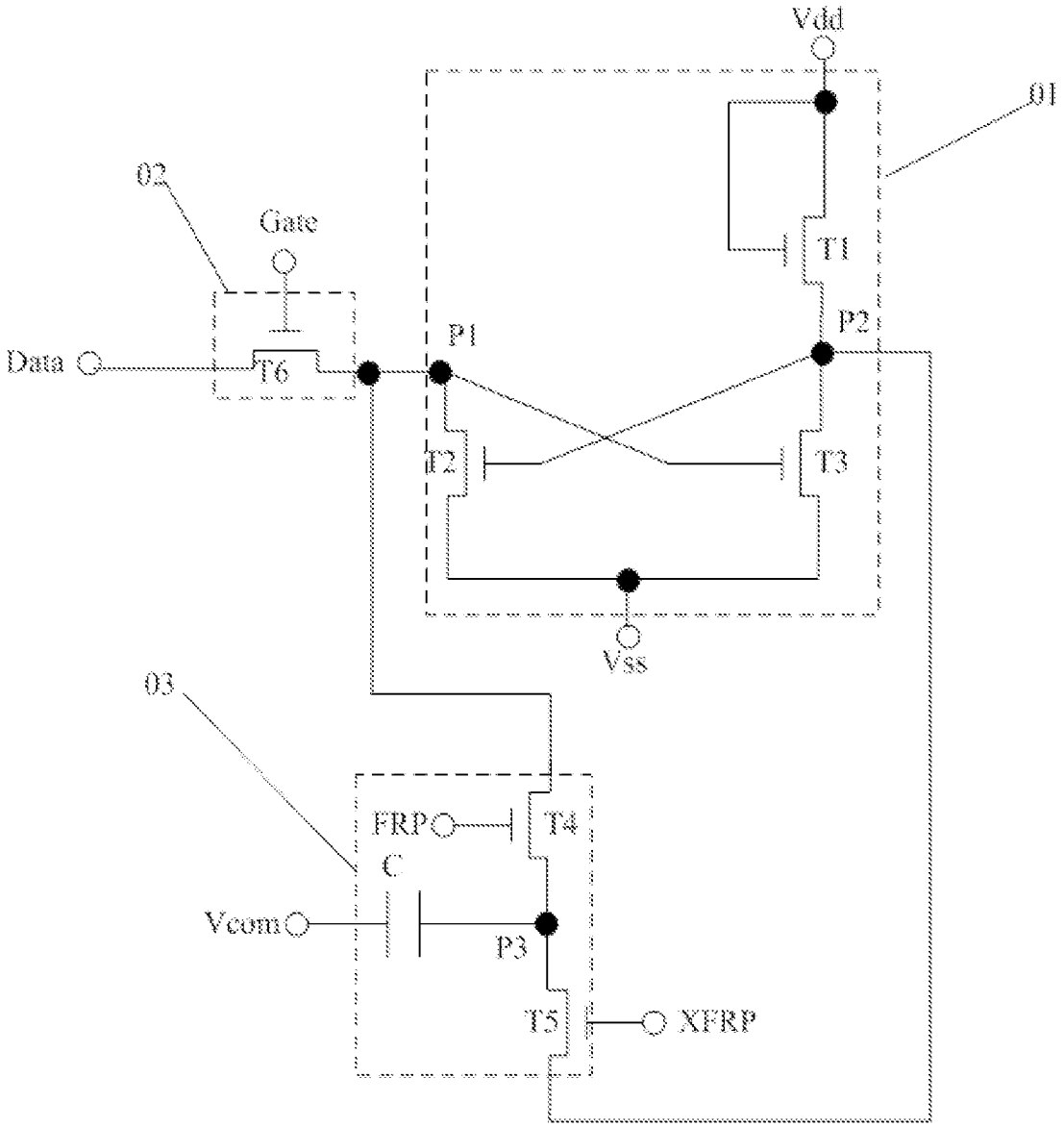

In a specific implementation, in the pixel circuit according to the embodiment of the present disclosure, as shown in FIG. 2 and FIG. 3, the storage module 01 may include: a first switch transistor T1, a second switch transistor T2, and a third switch transistor T3. A gate and a source of the first switch transistor T1 are connected to a high-level power supply terminal VDD (i.e., for inputting a first power supply signal Vdd), and a drain of the first switch transistor T1 is connected to the second node P2. A gate of the second switch transistor T2 is connected to the second node P2, a source of the second switch transistor T2 is connected to a low-level power supply terminal VSS (i.e., for inputting a second power supply signal Vss), and a drain of the second switch transistor T2 is connected to the first node P1. A gate of the third switch transistor T3 is connected to the first node P1, a source of the third switch transistor T3 is connected to the low-level power supply terminal VSS (i.e., for inputting the second power supply signal Vss), and a drain of the third switch transistor T3 is connected to the second node P2. Specifically, the first switch transistor may be turned on under the control of the first power signal, and the turned-on first switch transistor may output the first power signal at the second node. The second switch transistor may be turned on under the control of the second node, and the turned-on second switch transistor may output the second power signal at the first node. The third switch transistor may be turned on under the control of the voltage of the first node, and the turned-on third switch transistor may output the second power signal at the second node.

In a specific implementation, in the pixel circuit according to the embodiment of the present disclosure, the data signal may be written into the storage module by the writing module, and the driving signal for driving the pixel unit to emit light may be output at the third node by the driving module.

In a specific implementation, in the pixel circuit according to the embodiment of the present disclosure, as shown in FIG. 1, a first control terminal of the driving module 03 is connected to the first node P1, and a second control terminal is connected to the second node P2. A first input terminal is connected to receive a first display signal FRP, a second input terminal is connected to receive a second display signal XFRP, a third input terminal is connected to receive a common voltage signal Vcom. The driving module 03 is configured to generate, at the third node P3, a drive signal for driving a pixel unit to emit light, under the control of the first node P1 and the second node P2, according to the first display signal FRP, the second display signal XFRP, and the common voltage signal Vcom.

Specifically, in the pixel circuit according to the embodiment of the present disclosure, as shown in FIG. 2, the driving module 03 may include: a fourth switch transistor T4, a fifth switch transistor T5 and a capacitor C. A gate of the fourth switch transistor T4 is connected to the first node P1, a source of the fourth switch transistor T4 is connected to receive the first display signal FRP, and a drain of the fourth switch transistor T4 is connected to the third node P3. A gate of the fifth switch transistor T5 is connected to a second node P2, a source of the fifth switch transistor T5 is connected to receive the second display signal XFRP, and a drain of the fifth switch transistor T5 is connected to the third node P3. The capacitor C may be formed of a common electrode and a pixel electrode insulated from each other, with one terminal connected to receive the common voltage signal Vcom, and the other terminal connected to the third node P3. Specifically, the fourth switch transistor may be turned on under the control of the voltage of the first node, and the turned-on fourth switch transistor may output the first display signal at the third node P3 to charge the capacitor C so as to form an electric field for driving the pixel to emit light, i.e., the voltage signal Vpixel of the third node P3 is used to drive the pixel unit to emit light. The fifth switch transistor may be turned on under the control of the voltage of the second node, and the turned-on fifth switch transistor may output the second display signal at the third node P3.

As another example, in a specific implementation, in the above pixel circuit according to the embodiment of the present disclosure, as shown in FIG. 3, a first control terminal of the driving module 03 is connected to receive a first display signal FRP, a second control terminal of the driving module 03 is connected to receive a second display signal XFRP, a first input terminal is connected to the first node P1, a second input terminal is connected to the second node P2, and a third input terminal is connected to receive a common voltage signal Vcom. The driving module is configured to generate, at the third node P3, a drive signal for driving a pixel unit to emit light, under the control of the first display signal FRP and the second display signal XFRP, according to the voltages of the first node P1 and the second node P2, and the common voltage signal Vcom.

Specifically, in the pixel circuit according to the embodiment of the present disclosure, as shown in FIG. 3, the driving module 03 may include: a fourth switch transistor T4, a fifth switch transistor T5, and a capacitor C. A gate of the fourth switch transistor T4 is connected to receive the first display signal FRP, a source of the fourth switch transistor T4 is connected to the first node P1, and a drain of the fourth switch transistor T4 is connected to the third node P3. A gate of the fifth switch transistor T5 is connected to receive the second display signal XFRP, a source of the fifth switch transistor T5 is connected to the second node P2, and a drain of the fifth switch transistor is connected to the third node P3. The capacitor C may be formed of a common electrode and a pixel electrode insulated from each other, with one terminal connected to receive the common voltage signal Vcom, and the other terminal connected to the third node P3. Specifically, the fourth switch transistor may be turned on under the control of the first display signal, and the turned-on fourth switch transistor may output the signal of the first node at the third node P3 to charge the capacitor C so as to form an electric field for driving the pixel to emit light, i.e., the voltage signal Vpixel of the third node P3 is used to drive the pixel unit to emit light. The fifth switch transistor may be turned on under the control of the second display signal, and the turned-on fifth switch transistor may output the signal of second node at the third node P3.

In a specific implementation, in the above pixel circuit provided in the embodiment of the present disclosure, as shown in FIG. 1, a control terminal of the writing module 02 is connected to receive the scan signal Gate, an input terminal is connected to receive the data signal Data, and an output terminal is connected to the first node P1. The write module is configured to output the data signal Data at the first node P1 under the control of the scan signal Gate.

Specifically, in the foregoing pixel circuit according to the embodiment of the present disclosure, as shown in FIG. 2 and FIG. 3, the writing module 02 may include: a sixth switch transistor T6. A gate of the sixth switch transistor T6 is connected to receive the scan signal Gate, a source of the sixth switch transistor T6 is connected to a data line (i.e., for inputting the data signal Data), and a drain of the sixth switch transistor T6 is connected to the first node P1. Specifically, the sixth switch transistor may be turned on under the control of the scan signal, and the turned-on sixth switch transistor may output the data signal at the first node.

Based on the same inventive concept, an embodiment of the present disclosure provides a display panel, which includes the above pixel circuit according to the embodiment of the present disclosure. The display panel may be applied to any product or component having a display function such as a mobile phone, a tablet computer, a television set, a monitor, a notebook computer, a digital photo frame, a navigator, and the like. Since the principle by which the display panel solves its problem is similar to that of the pixel circuit, the implementation of the display panel can refer to the above implementation of the pixel circuit, and thus repeated descriptions will be omitted.

Based on the same inventive concept, an embodiment of the present disclosure provides a method for driving the foregoing pixel circuit according to the embodiment of the present disclosure, which may include:

outputting, by the writing module, a data signal to a storage module under the control of a scan signal; and controlling, by the storage module, the potentials of a first node and a second node under the control of a first power signal and a second power signal, together with the data signal outputted by the writing module which has been received and stored in the storage module; and generating, by the driving module, a driving signal for driving the pixel unit to emit light according to the potentials of the first node and the second node.

It should be noted that the switch transistor mentioned in the above embodiments of the present disclosure may be a thin film transistor (TFT) or a metal oxide semiconductor (MOS) field effect transistor, which is not limited herein. Moreover, the transistor may be a P-type transistor or an N-type transistor, which is also not limited herein. In addition, in a specific implementation, the source and the drain of these transistors may be interchangeable with each other. In the description of a specific embodiment, the thin film transistor is taken as an example for illustration.

The work flow of the pixel circuit according to the embodiment of the present disclosure will be described in detail below in conjunction with the timing of the pixel circuit and the control signal according to the embodiment of the present disclosure. The work flow of the pixel circuit according to the embodiment of the present disclosure is described with the pixel circuit shown in FIG. 2 and the control signal timing diagram shown in FIGS. 4*a* and 4*b*. Specifically, in the following description, 1 represents a high-level signal, and 0 represents a low-level signal The first switch transistor, the second switch transistor, the third switch transistor, the fourth switch transistor, the fifth switch transistor, and the sixth switch transistor in the pixel circuit take an N-type transistor as an example; it is assumed that the first power signal Vdd is a high-level signal, the second power signal Vss is a low-level signal, and the first display signal FRP is configured to input a voltage signal in phase with the common voltage signal Vcom (both are high-level or low-level), and the second display signal XFRP is configured to input a voltage signal out of phase with the common voltage signal Vcom (one of which is low-level while the other is high-level).

Figure 4A:
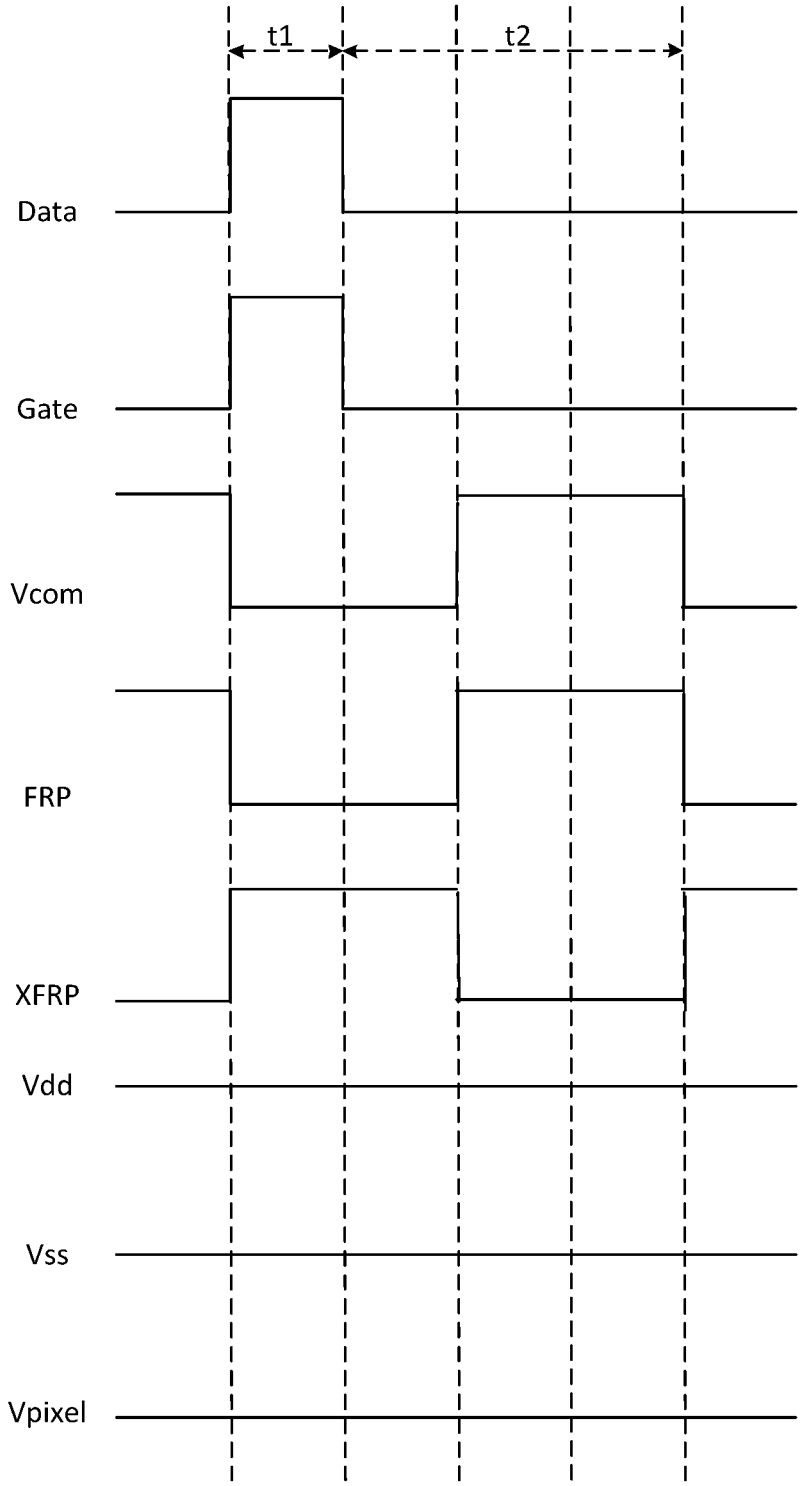
FIG. 4*a* and FIG. 4*b* are timing diagrams of pixel circuits according to embodiments of the present disclosure.

There are two stages for a pixel: a pixel updating stage and a pixel holding stage. The pixel updating stage is a frame during which the pixel changes. During the frame duration, the pixel circuit stores the written data signal and correspondingly changes a pixel driving voltage value. In the following frame for a subsequent display, when the displayed pixel needs not to be updated, the stored data signal may continue to be used without the need to write the data signal into each pixel unit via a data line and a data writing circuit frame by frame by means of, for example, progressive scanning, thereby reducing power consumption. Taking a Normal Black display mode pixel as an example, the processes of displaying and holding a black or white pixel are described respectively as follows:

As shown in FIG. 4*a*, in a pixel updating phase t1, Gate=1, Vcom=0, Vdd=1, and Vss=0, and meanwhile Data=1, FRP=0, and XFRP=1. Since Vdd=1 and Gate=1, the first switch transistor T1 and the sixth switch transistor T6 are turned on. The turned-on sixth switch transistor T6 outputs the data signal Data at the first node P1, and thus the potential of the first node P1 is pulled up to be up so that the third switch transistor T3 and the fourth switch transistor T4 are turned on. The turned-on first switch transistor T1 outputs the first power supply signal Vdd at the second node P2. However, since the third switch transistor T3 is turned on, the potential of the second node P2 is pulled down to be low, so that the second switch transistor T2 is turned off. The turned-on fourth switch transistor T4 outputs the first display signal FRP at the third node P3. At the time, the voltage signal Vpixel of the third node P3 is the voltage difference of the first display signal FRP with respect to the common voltage signal Vcom. The first display signal FRP and the the common voltage signal Vcom are the same, so that the voltage signal Vpixel is 0 (that is, low level). Therefore, the pixel is displayed as being in a state where no driving voltage is applied, that is, in a black state for the pixel in a Normal Black display mode.

In a corresponding pixel holding stage t2, when the scan signal line inputs a scan-off signal of low level, i.e., Gate=0, or the data line does not update the data signal Data, the first node P1 may continue to remain at a high level, and the second node P2 may continue to remain at at a low level, and the fourth transistor T4 remains on. By making the common voltage signal in phase with the first display signal and out of phase with the second display signal, the voltage difference of the first display signal FRP with respect to the common voltage signal Vcom can be held, so as to hold the voltage signal Vpixel at 0, thereby the pixel driven by the pixel driving circuit keeps in a black state.

Figure 4B:
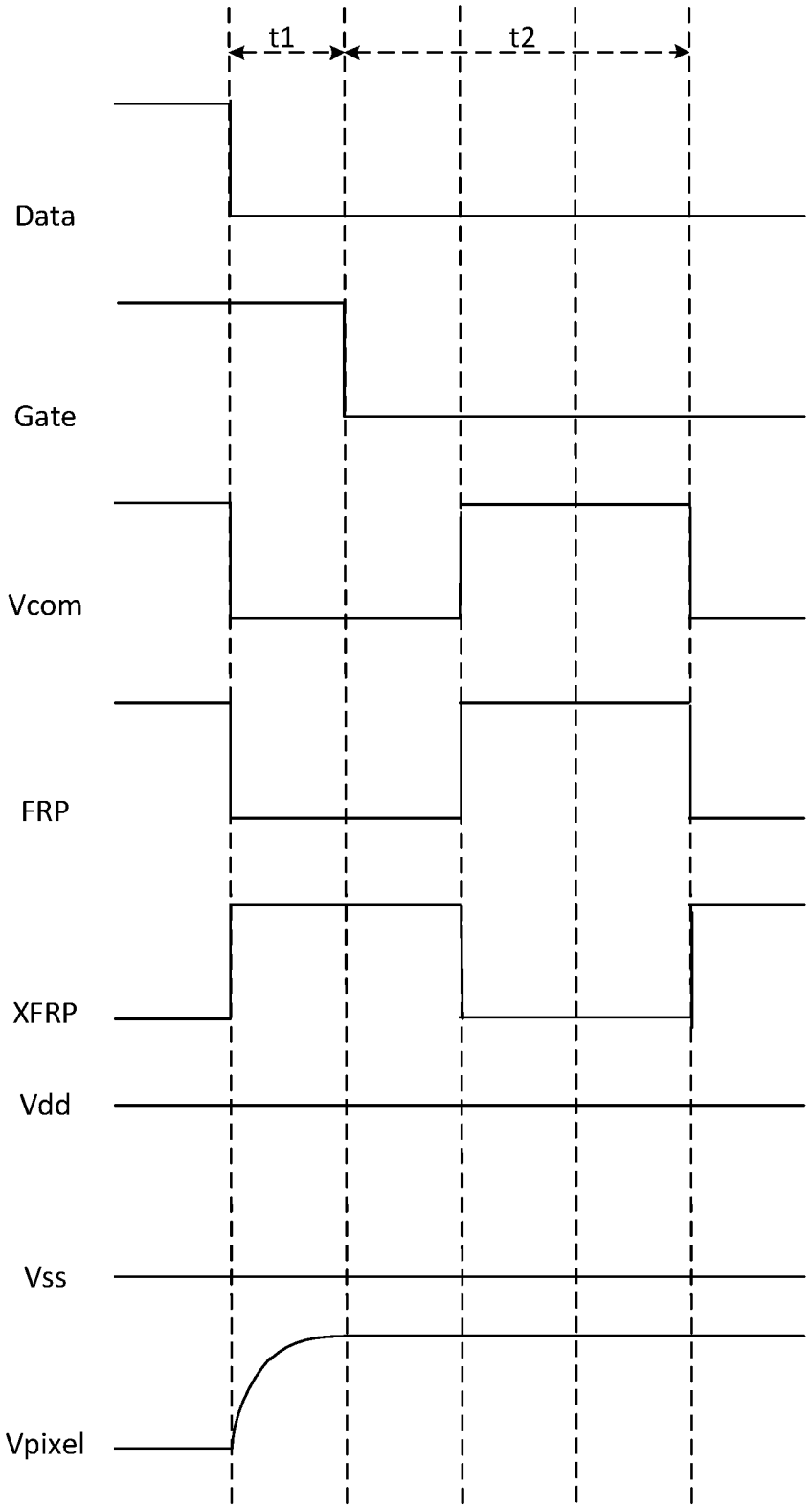

As shown in FIG. 4*b*, in another pixel updating phase t1, Gate=1, Vcom=0, Vdd=1, and Vss=0, and meanwhile, Data=0, FRP=0, and XFRP=1. Since Vdd=1 and Gate=1, the first switch transistor T1 and the sixth switch transistor T6 are turned on; and since Data=0, the turned-on sixth switch transistor T6 outputs the data signal Data at the first node P1, and thus the potential of the first node P1 is pulled down to be low. The turned-on first switch transistor T1 outputs the first power signal Vdd at the second node P2, and the potential of the second node P2 is pulled up to be high, so that the second switch transistor T2 and the fifth switch transistor T5 are turned on. The turned-on second switch transistor T2 pulls down the potential of the first node P1. The turned-on fifth switch transistor T5 outputs the second display signal XFRP at the third node P3. At the time, the voltage signal Vpixel of the third node P3 is the voltage difference of the second display signal XFRP with respect to the common voltage signal Vcom. Since XFRP=1, the second display signal XFRP is opposite to the common voltage signal Vcom, so that the voltage signal Vpixel is 1 (i.e., high level). Therefore, the pixel is displayed as being in a state where a driving voltage is applied, that is, in a white state for the pixel in a Normal Black display mode.

In a corresponding pixel holding stage t2, when the scan signal line inputs a scan-off signal of low level, i.e., Gate=0, or the data line does not update the data signal Data, the first node P1 may continue to remain at a low level, and the second node P2 may continue to remain at a high level, and the fifth transistor T5 remains on. By making the common voltage signal in phase with the first display signal and out of phase with the second display signal, the voltage difference of the second display signal XFRP with respect to the common voltage signal Vcom can be held, so as to hold the voltage signal Vpixel at 1, thereby the pixel driven by this pixel driving circuit keeps in a white state.

In a specific implementation, when a pixel driving is performed using the pixel circuit as shown in FIG. 3, the process and principle for implementing the pixel driving are similar with those described in the above embodiment. There are two stages for a pixel: a pixel updating stage and a pixel holding stage. The pixel updating stage is a frame during which the pixel changes. During the frame duration, the pixel circuit stores the written data signal and correspondingly changes a pixel driving voltage value. In the following frame for a subsequent display, when the displayed pixel needs not to be updated, the stored data signal may continue to be used without the need to write the data signal into each pixel unit via a data line and a data writing circuit frame by frame by means of, for example, progressive scanning, thereby reducing power consumption. The difference is that the voltage applied at the third node P3 is changed, from the voltage difference between the first display signal FRP voltage or the second display signal XFRP voltage and the common voltage Vcom, to the voltage difference between the voltage of the first node P1 or the voltage of the second node P2 and the common voltage signal.

As shown in FIG. 4*a*, in a pixel updating phase t1, Gate=1, Vcom=0, Vdd=1, and Vss=0, and meanwhile Data=1, FRP=0, and XFRP=1. Since Vdd=1 and Gate=1, the first switch transistor T1 and the sixth switch transistor T6 are turned on. The turned-on sixth switch transistor T6 outputs the data signal Data at the first node P1, and thus the potential of the first node P1 is pulled up to be high so that the third switch transistor T3 is turned on. The turned-on first switch transistor T1 outputs the first power supply signal Vdd at the second node P2. However, since the third switch transistor T3 is turned on, the potential of the second node P2 is pulled down to be low, so that the second switch transistor T2 is turned off. Since FRP=0 and XFRP=1, the fourth switch transistor T4 is turned off, and the fifth switch transistor T5 is turned on. The turned-on fifth transistor T5 outputs the voltage of the second node P2 at the third node P3. At the time, the voltage signal Vpixel of the third node P3 is the voltage difference of the voltage of the second node P2 with respect to the common voltage signal Vcom. The voltage of the second node P2 is at a low level, and the common voltage signal Vcom is also at a low level, that is, the input voltages are the same, so that the voltage signal Vpixel is 0 (i.e., low level). Therefore, the pixel is displayed as being in a state where no driving voltage is applied, that is, in a black state for the pixel in a Normal Black display mode.

In a corresponding pixel holding stage t2, when the scan signal line inputs a scan-off signal of low level, i.e., Gate=0, or the data line does not update the data signal Data, the first node P1 may continue to remain at a high level, and the second node P2 may continue to remain at a low level. By making the common voltage signal in phase with the first display signal and out of phase with the second display signal, when Vcom=0, FRP=0 and XFRP=1, the turned-on fifth transistor T5 outputs the voltage of the second node P2 at the third node P3. At the time, the voltage signal Vpixel of the third node P3 is the voltage difference of the voltage of the second node P2 with respect to the common voltage signal Vcom. The second node P2 is at a low level, and the common voltage signal Vcom is also at a low level, that is, the input voltages are the same, so that the voltage signal Vpixel is 0 (i.e., low level). When Vcom=1, FRP=1, and XFRP=0, the turned-on fifth transistor T4 outputs the voltage of the first node P1 at the third node P3. At the time, the voltage signal Vpixel of the third node P3 is the voltage difference of the voltage of the first node P1 with respect to the common voltage signal Vcom. The first node P1 is at a high level, and the common voltage signal Vcom is also at a high level, that is, the input voltages are the same, so that the voltage signal Vpixel is 0 (i.e., low level), thereby the pixel driven by the pixel driving circuit keeps in a black state.

As shown in FIG. 4*b*, in another pixel updating phase t1, Gate=1, Vcom=0, Vdd=1, and Vss=0, and meanwhile, Data=0, FRP=0, and XFRP=1. Since Vdd=1 and Gate=1, the first switch transistor T1 and the sixth switch transistor T6 are turned on; and since Data=0, the turned-on sixth switch transistor T6 outputs the data signal Data at the first node P1, and thus the potential of the first node P1 is pulled down to be low. The turned-on first switch transistor T1 outputs the first power signal Vdd at the second node P2, and the potential of the second node P2 is pulled up to be high, so that the second switch transistor T2 is turned on. The turned-on second switch transistor T2 pulls down the potential of the first node P1. Since FRP=0 and XFRP=1, the fourth switch transistor T4 is turned off, and the fifth switch transistor T5 is turned on. The turned-on fifth transistor T5 outputs the voltage of the second node P2 at the third node P3. At the time, the voltage signal Vpixel of the third node P3 is the voltage difference of the voltage of the second node P2 with respect to the common voltage signal Vcom. The voltage of the second node P2 is at a high level, and the common voltage signal Vcom is at a low level, so that the voltage signal Vpixel is 1 (i.e., high level). Therefore, the pixel is displayed as being in a state where a driving voltage is applied, that is, in a white state for the pixel in a Normal Black display mode.

In a corresponding pixel holding stage t2, when the scan signal line inputs a scan-off signal of low level, i.e., Gate=0, or the data line does not update the data signal Data, the first node P1 may continue to remain at a low level, and the second node P2 may continue to remain at a high level. By making the common voltage signal in phase with the first display signal and out of phase with the second display signal, when Vcom=0, FRP=0 and XFRP=1, the turned-on fifth transistor T5 outputs the voltage of the second node P2 at the third node P3. At the time, the voltage signal Vpixel of the third node P3 is the voltage difference of the voltage of the second node P2 with respect to the common voltage signal Vcom. The second node P2 is at a high level, and the common voltage signal Vcom is at a low level, so that the voltage signal Vpixel is 1 (i.e., high level). When Vcom=1, FRP=1, and XFRP=0, the turned-on fifth transistor T4 outputs the voltage of the first node P1 at the third node P3. At the time, the voltage signal Vpixel of the third node P3 is the voltage difference of the voltage of the first node P1 with respect to the common voltage signal Vcom. The first node P1 is at a low level, and the common voltage signal Vcom is at a high level, so that the voltage signal Vpixel is 1 (i.e., high level), thereby the pixel driven by this pixel driving circuit keeps in a white state.

Figure 5:
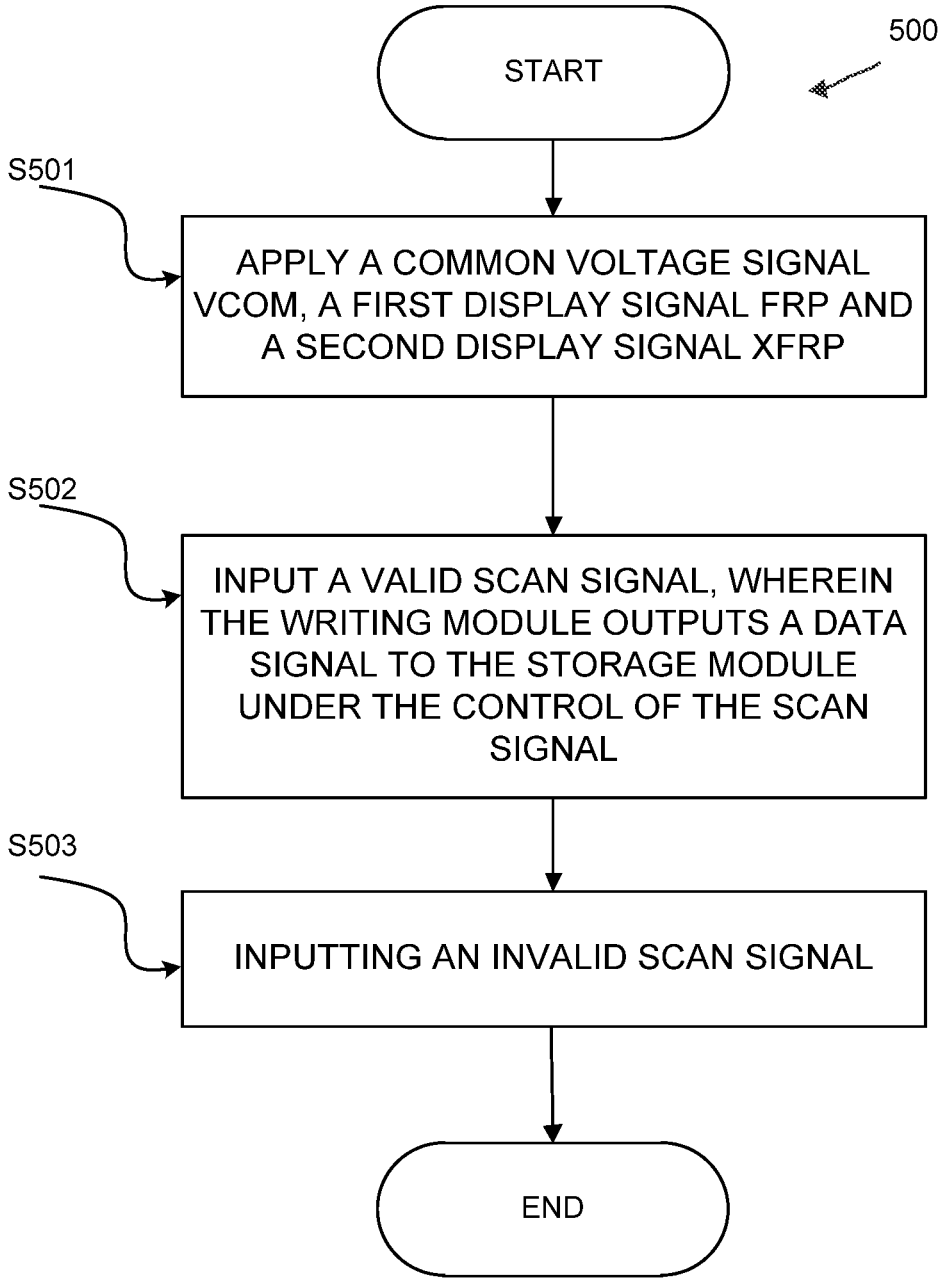
FIG. 5 shows a driving method of a pixel driving circuit according to an embodiment of the present disclosure.

An embodiment of the present disclosure provides a method for driving the foregoing pixel circuit of the embodiment of the present disclosure. FIG. 5 shows a driving method of a pixel driving circuit according to an embodiment of the present disclosure. As shown in FIG. 5, the driving method 500 includes:

At step S501, applying a common voltage signal Vcom, a first display signal FRP and a second display signal XFRP;

At step S502, inputting a valid scan signal, wherein the writing module outputs a data signal to the storage module under the control of the scan signal; and At step S503, inputting an invalid scan signal after one scan period.

In embodiments of the present disclosure, a valid signal refers to a signal that can turn a switch transistor on, and an invalid signal refers to a signal that turns a switch transistor off. For example, for an N-type transistor, the valid signal is a high-level signal and the invalid signal is a low-level signal. For a P-type transistor, the valid signal is a low-level signal and the invalid signal is a high-level signal.

According to an embodiment of the present disclosure, the driving method 500 further includes: when the data signal needs to be updated, repeating steps S502 and S503, i.e., inputting a valid scan signal so that the writing module outputs the updated data signal to the storage module under the control of the scan signal; and inputting an invalid scan signal after one scan period.

According to an embodiment of the present disclosure, the common voltage signal Vcom is in phase with the first display signal FRP, and out of phase with the second display signal XFRP.

Embodiments of the present disclosure provide a pixel circuit, a driving method thereof and a display panel. The pixel circuit includes: a writing module, a driving module and a storage module. An output terminal of the writing module is connected to the storage module via a first node. The writing module is configured to output a data signal at the first node under the control of a scan signal. The storage module is connected between the first node and a second node. The storage module is configured to control the potential of the second node under the control of a first power signal and a second power signal, together with the data signal outputted by the writing module which has been received and stored in the storage module. The driving module connects to the first node and to the second node. The driving module is configured to generate, at the third node, a drive signal for driving a pixel unit to emit light under the control of a common voltage signal, a first display signal, a second display signal, and the potentials of the first node and the second node. Thereby, the written data signal is stored in the first node by the storage module, and then the potential of the second node is controlled according to the stored data signal, so that the pixel circuit outputs a driving signal for driving the pixel unit to emit light under the control of key nodes (i.e., the first node and the second node) to achieve normal light emission of the pixel. When the pixel circuit is applied in a display device, the data signal stored by the storage module may replace a data signal input from a data line when a still picture is displayed, which can reduce the power consumption of the display device. Meanwhile, the pixel circuit of the present disclosure has a simple structure and facilitates the reduction of the area occupied by the pixel circuit.

It will be apparent to those skilled in the art that various modifications and variations can be made in the present disclosure without departing from the spirit and scope of the invention. Thus, if these modifications and variations of the present disclosure fall within the scope of the claims of the present disclosure and their equivalents, the present invention is also intended to include these modifications and variations.

We claim:

1. A pixel circuit, comprising a writing module, a driving module, and a storage module, wherein:

an output terminal of the writing module is connected to the storage module via a first node, and the writing module is configured to output a data signal at the first node under control of a scan signal;

the storage module is connected between the first node and a second node, the storage module is configured to control a voltage of the second node under control of a first power signal and a second power signal, together with the data signal outputted by the writing module which has been received and stored in the storage module; and the driving module connects to the first node and the second node, the driving module is configured to generate, at a third node, a drive signal for driving a pixel unit to emit light under control of a common voltage signal, a first display signal, a second display signal, and voltages of the first node and the second node, wherein the common voltage signal is in phase with the first display signal, and out of phase with the second display signal.

2. The pixel circuit of claim 1, wherein the storage module comprises a first switch transistor, a second switch transistor, and a third switch transistor; wherein:

a gate and a first electrode of the first switch transistor are connected to receive the first power supply signal, and a second electrode of the first switch transistor is connected to the second node;

a gate of the second switch transistor is connected to the second node, a first electrode of the second switch transistor is connected to receive the second power signal, and a second electrode of the second switch transistor is connected to the first node;

a gate of the third switch transistor is connected to the first node, a first electrode of the third switch transistor is connected to receive the second power signal, and a second electrode of the third switch transistor is connected to the second node; and the first electrode of one of the first, second and third switch transistors is one of a source and a drain, and the second electrode is the other of the source and the drain.

3. The pixel circuit of claim 2, wherein the first switch transistor, the second switch transistor and the third switch transistor are N-type transistors.

4. The pixel circuit of claim 3, wherein a first control terminal of the driving module is connected to receive the first display signal, a second control terminal of the driving module is connected to receive the second display signal, a first input terminal of the driving module is connected to the first node, a second input terminal of the driving module is connected to the second node, a third input terminal of the driving module is connected to receive the common voltage signal, and the driving module is configured to generate, at the third node, a drive signal for driving a pixel unit to emit light, under control of the first display signal and the second display signal, according to the first node, the second node, and the common voltage signal.

5. The pixel circuit of claim 2, wherein a first control terminal of the driving module is connected to receive the first display signal, a second control terminal of the driving module is connected to receive the second display signal, a first input terminal of the driving module is connected to the first node, a second input terminal of the driving module is connected to the second node, a third input terminal of the driving module is connected to receive the common voltage signal, and the driving module is configured to generate, at the third node, a drive signal for driving a pixel unit to emit light, under control of the first display signal and the second display signal, according to the first node, the second node, and the common voltage signal.

6. The pixel circuit of claim 1, wherein the first power signal is a high-level signal, and the second power signal is a low-level signal.

7. The pixel circuit of claim 6, wherein a first control terminal of the driving module is connected to receive the first display signal, a second control terminal of the driving module is connected to receive the second display signal, a first input terminal of the driving module is connected to the first node, a second input terminal of the driving module is connected to the second node, a third input terminal of the driving module is connected to receive the common voltage signal, and the driving module is configured to generate, at the third node, a drive signal for driving a pixel unit to emit light, under control of the first display signal and the second display signal, according to the first node, the second node, and the common voltage signal.

8. The pixel circuit of claim 1, wherein a first control terminal of the driving module is connected to the first node, a second control terminal of the driving module is connected to the second node, a first input terminal of the driving module is connected to receive the first display signal, a second input terminal of the driving module is connected to receive the second display signal, a third input terminal of the driving module is connected to receive the common voltage signal, and the driving module is configured to generate, at the third node, a drive signal for driving a pixel unit to emit light, under control of the voltages of the first node and the second node, according to the first display signal, the second display signal, and the common voltage signal.

9. The pixel circuit of claim 8, wherein the driving module comprises a fourth switch transistor, a fifth switch transistor, and a capacitor, wherein:

a gate of the fourth switch transistor is connected to the first node, a first electrode of the fourth switch transistor is connected to receive the first display signal, and a second electrode of the fourth switch transistor is connected to the third node;

a gate of the fifth switch transistor is connected to the second node, a first electrode of the fifth switch transistor is connected to receive the second display signal, and a second electrode of the fifth switch transistor is connected to the third node;

a first terminal of the capacitor is connected to receive the common voltage signal, and a second terminal of the capacitor is connected to the third node; and the first electrode of one of the fourth and fifth switch transistors is one of a source and a drain, and the second electrode is the other of the source and the drain.

10. The pixel circuit of claim 1, wherein a first control terminal of the driving module is connected to receive the first display signal, a second control terminal of the driving module is connected to receive the second display signal, a first input terminal of the driving module is connected to the first node, a second input terminal of the driving module is connected to the second node, a third input terminal of the driving module is connected to receive the common voltage signal, and the driving module is configured to generate, at the third node, a drive signal for driving a pixel unit to emit light, under control of the first display signal and the second display signal, according to the first node, the second node, and the common voltage signal.

11. The pixel circuit of claim 10, wherein the driving module comprises a fourth switch transistor, a fifth switch transistor, and a capacitor, wherein:

a gate of the fourth switch transistor is connected to receive the first display signal, a first electrode of the fourth switch transistor is connected to the first node, and a second electrode of the fourth switch transistor is connected to the third node;

a gate of the fifth switch transistor is connected to receive the second display signal, a first electrode of the fourth switch transistor is connected to the second node, and a second electrode of the fourth switch transistor is connected to the third node;

one terminal of the capacitor is connected to receive the common voltage signal, and the other terminal is connected to the third node; and the first electrode of one of the fourth and fifth switch transistors is one of a source and a drain, and the second electrode is the other of the source and the drain.

12. The pixel circuit of claim 1, wherein a control terminal of the writing module is connected to receive the scan signal, an input terminal of the writing module is connected to receive the data signal, an output terminal of the writing module is connected to the first node, and the writing module is configured to output the data signal at the first node under the control of the scan signal.

13. The pixel circuit of claim 12, wherein the writing module comprises a sixth switch transistor, wherein:

a gate of the sixth switch transistor is connected to receive the scan signal, a first electrode of the sixth switch transistor is connected to receive the data signal, and a second electrode of the sixth switch transistor is connected to the first node; and the first electrode of the sixth switch transistor is one of a source and a drain, and the second electrode is the other of the source and the drain.

14. A display panel comprising a pixel circuit of claim 1.

15. A driving method for a pixel circuit of claim 1, comprising:

applying the common voltage signal, the first display signal and the second display signal;

inputting a valid scan signal, wherein the writing module outputs the data signal to the storage module under the control of the scan signal; and inputting an invalid scan signal after one scan period, wherein the common voltage signal is in phase with the first display signal, and out of phase with the second display signal.

16. The driving method of claim 15, further comprising:

when the data signal needs to be updated, inputting the valid scan signal so that the writing module outputs the updated data signal to the storage module under the control of the scan signal; and inputting the invalid scan signal after one scan period.

* * * * *